US006334559B1

(12) United States Patent
Armaly

(10) Patent No.: US 6,334,559 B1
(45) Date of Patent: Jan. 1, 2002

(54) HANGER WITH AN OPENABLE MAIN BODY

(75) Inventor: Katherine Elizabeth Armaly, Grosse Pointe Shores, MI (US)

(73) Assignee: Hold-It Products, Walled Lake, MI (US)

( * ) Notice: Subject to any disclaimer, the term of this patent is extended or adjusted under 35 U.S.C. 154(b) by 0 days.

(21) Appl. No.: 09/756,266

(22) Filed: Jan. 9, 2001

(51) Int. Cl.[7] ..... A47S 25/14
(52) U.S. Cl. ..... 223/85
(58) Field of Search ..... 223/85, 89, 94; D6/315

(56) References Cited

U.S. PATENT DOCUMENTS

| | | | |
|---|---|---|---|
| 1,099,261 | A | 6/1914 | Lewyt |
| 1,929,284 | A | 10/1933 | Misbach |
| D103,835 | S | 3/1937 | Stanley |
| D141,849 | S | 7/1945 | Salesky |
| D180,823 | S | 8/1957 | Erdmann |
| 3,474,942 | A | 10/1969 | Scheuermann |

FOREIGN PATENT DOCUMENTS

| | | |
|---|---|---|
| JP | 5-103899 | 4/1993 |

OTHER PUBLICATIONS

Circular, Walter Drake & Son, Inc., Copyright 1978.

*Primary Examiner*—Bibhu Mohanty
(74) *Attorney, Agent, or Firm*—Oblon, Spivak, McClelland, Maier & Neustadt, P.C.

(57) ABSTRACT

A hanger which may find particular application to hanging items which contain a loop portion, such as ponytail holders, belts, etc. The hanger includes a hooking portion to be hooked onto a closet rod, hook, etc. Further, a main body of the hanger is connected to the hooking portion and includes first and second connecting/disconnecting portions which can connect and disconnect with each other. Both of the first and second connecting/disconnecting portions connect and disconnect at a central portion of the main body. The items to be hung can thus be placed on the main body when the connecting/disconnecting portions are unconnected, and can then be secured by then connecting the connecting/disconnecting portions.

16 Claims, 1 Drawing Sheet

HANGER WITH AN OPENABLE MAIN BODY

BACKGROUND OF THE INVENTION

1. Field of the Invention

The present invention is directed to a hanger which can hold several items which contain a loop portion, such as ponytail holders, often referred to as scrunchies, belts, etc. The hanger of the present invention has a design in which a center portion is openable to easily place the loop items onto the hanger and to easily remove the loop items from the hanger.

2. Discussion of the Background

It is often troublesome for someone to store items with loop portions. For example, it is often difficult to find the proper storage for belts, ponytail holders often known as scrunchies, etc. Since these items have a loop portion they are often placed on a single hook in a closet. However, if a person has many of such items, it may be difficult to have enough storage space on the hook. Also, particularly with respect to items such as ponytail holders which are small, it is often very difficult to keep track of all of the ponytail holders a person may have and to keep all of the ponytail holders from becoming disordered and messy.

Further, in a case of a person who has many ponytail holders, if the ponytail holders are placed on a hook and a person wants to retrieve a ponytail holder at the bottom of the hook, the person may have to remove all of the ponytail holders above that desired ponytail holder to properly get at the desired ponytail holders. As a result, the person may not place back all of the ponytail holders or feel annoyed at the effort required to get at the desired ponytail holder.

OBJECTS OF THE INVENTION

Accordingly, one object of the present invention is to provide a novel hanger design which allows a person to easily store items with loop portions such as ponytail holders, belts, etc.

A further object of the present invention is to provide a novel hanger design which allows a person to store items such as ponytail holders, belts, etc. in a manner such that the person can easily access a desired ponytail holder, belt, etc. stored on the hanger.

A further object of the present invention is to provide a novel hanger for items such as ponytail holders, belts, etc. which is simple in design.

A further object of the present invention is to provide a novel hanger for storing items such as ponytail holders, belts, etc. which can be easily manufactured.

SUMMARY OF THE INVENTION

To achieve the above and other objects, the present invention provides a novel hanger which includes a hooking portion to be hooked onto a closet rod, hook, etc. Further, a main body of the hanger is connected to the hooking portion and includes first and second connecting/disconnecting portions which can connect and disconnect with each other. Both of the first and second connecting/disconnecting portions connect and disconnect at a central portion of the main body.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
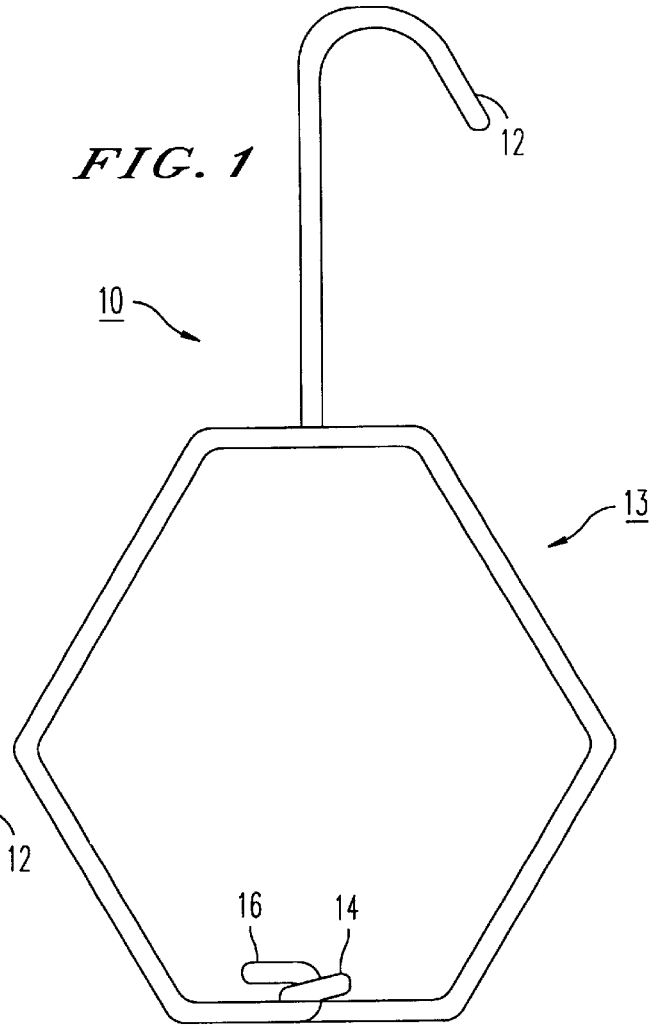
FIG. 1 shows an embodiment of the novel hanger design of the present invention in a connected state.
Figure 2:
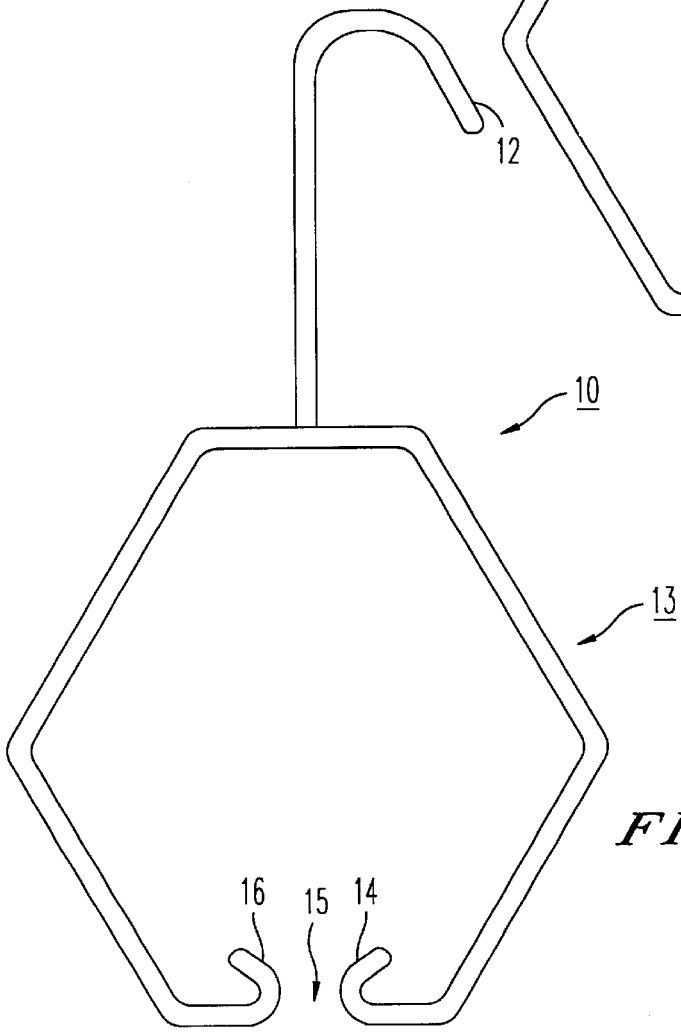
FIG. 2 shows a construction of the novel hanger design of the present invention in a disconnected state.

Referring now to the drawings, wherein like reference numerals designate identical or corresponding parts throughout the several views, and more particularly to FIGS. 1 and 2 thereof, the novel hanger design of the present invention is shown in detail.

As discussed above, the novel hanger design of the present invention is particularly well suited for allowing the hangings of items with loop portions such as ponytail holders, belts, etc., although the hanger of the present invention is not limited to such a use and may find use storing many different kinds of items.

To allow the easy storage of such items with a loop portion, the hanger of the present invention, as shown in FIGS. 1 and 2, includes a hooking portion 12 for hooking onto a closet rod, a hook, etc., as in a standard hanger design. Attached to the hooking portion 12 is a main body portion 13. In the example of the embodiment shown in FIGS. 1 and 2 the main body portion 13 is hexagonal shaped.

Further, at a center of a bottom of the main body portion 13, first and second connecting/disconnecting portions 14 and 16 are respectfully provided. That is, the main body portion 13 is formed as a single portion bent into a hexagon shape in which the ends are curved back on themselves to form respective connecting/disconnecting portions 14 and 16 each in a hook shape which can be connected and disconnected from each other.

FIG. 1 shows a construction in which the first and second connecting/disconnecting portions 14, 16 are in a connected state.

FIG. 2 shows a state in which the first and second connecting/disconnecting portions 14 and 16 are in a disconnected state.

In the state of FIG. 2, when the first and second connecting/disconnecting portions 14 and 16 are disconnected, due to the elasticity of the main body portion 13, a space 15 is formed between the first and second connecting/disconnecting portions 14, 16. That space 15 allows the items such as the ponytail holders, belts, etc., to be inserted and placed on the main body portion 13. After the item such as the ponytail holders, belts, etc. are placed onto the main body portion 13, the connecting/disconnecting portions 14 and 16 can then be connected such as shown in FIG. 1.

With such a construction a person can easily place the loop items onto the main body portion 13, and then can also easily undue the connecting/disconnecting portions 14, 16 to access the items placed on the main body 13 to remove them from the main body portion 13.

In the present invention it is also a significant point that the connecting/disconnecting portions 14, 16 are formed at a central portion of the main body portion 13. That allows easy access of all items stored on the main body portion 13 even if many items are stored on the main body portion 13. That is, if a person has stored many ponytail holders, as an example, on the main body portion 13, and the person desires to retrieve one particular ponytail holder, then with the hanger design of the present invention all the person has to do is slide all of the ponytail holders on one side of the desired ponytail holder to one side of the main body portion 13, then disconnect the connecting/disconnecting portions 14, 16, and at that state the desired ponytail holder will be right next to the space 15. The person can then simply remove the desired ponytail holder as it is next to the space 15 and then reconnect the connecting/disconnecting portions 14, 16.

In such a way, by appropriately placing the portion of the connecting/disconnecting portions 14, 16 at the center of the main body portion 13 a person can more easily access any of the desired items placed on the main body portion 13.

The shape of the main body portion 13 is not limited to the hexagonal shape as shown in FIGS. 1 and 2. However, the hexagonal shape shown in FIGS. 1 and 2 may provide an advantage in that the hexagon shape can be created by a simple modification of the existing standard hanger design. That is, the hexagonal shape for the main body portion 13 shown in FIGS. 1 and 2 can be easily generated by adopting the standard hanger design and introducing two more bends and the connecting/disconnecting portions 14, 16 thereto. That may simplify the manufacture of the hanger of FIGS. 1 and 2. Although, the hanger of the present invention is not limited to such a shape.

In FIGS. 1 and 2 the connecting/disconnecting portions 14 and 16 are shown as simple hook portions integrally formed at the end of the main body portion 13. Clearly, other connecting/disconnecting designs, including designs not integral to the main body portion, could be utilized.

Obviously, numerous additional modifications and variations of the present invention are possible in light of the above teachings. It is therefore to be understood that within the scope of the appended claims, the present invention may be practice otherwise than as specifically described herein.

What is claimed is:

1. A hanger comprising:

a hooking portion;

a main body portion connected to said hooking portion and including first and second connecting/disconnecting portions configured to connect and disconnect with each other, wherein said first and second connecting/disconnecting portions connect and disconnect at a center position on said main body portion, and wherein said hooking portion and said main body portion are substantially flat with each other.

2. A hanger comprising:

a hooking portion;

a main body portion connected to said hooking portion and including first and second connecting/disconnecting portions configured to connect and disconnect with each other, wherein said first and second connecting/disconnecting portions connect and disconnect at a center position on said main body portion, wherein said main body has a hexagon shape and said first and second connecting/disconnecting portions are connected and disconnected at a center of a bottom side of said hexagon.

3. A hanger according to claim 1, wherein said first and second connecting/disconnecting portions are an integral part of said main body.

4. A hanger according to claim 2, wherein said first and second connecting/disconnecting portions are an integral part of said main body.

5. A hanger according to claim 1, wherein said first and second connecting/disconnecting portions are each formed in a hook shape.

6. A hanger according to claim 2, wherein said first and second connecting/disconnecting portions are each formed in a hook shape.

7. A hanger according to claim 3, wherein said first and second connecting/disconnecting portions are each formed in a hook shape.

8. A hanger according to claim 4, wherein said first and second connecting/disconnecting portions are each formed in a hook shape.

9. A hanger comprising:

a hooking portion formed as a single wire hook;

a main body portion directly connected to said hooking portion and including first and second connecting/disconnecting portions configured to connect and disconnect with each other, wherein said first and second connecting/disconnecting portions connect and disconnect at a center position on said main body portion.

10. A hanger according to claim 9, wherein said main body has a hexagon shape and said first and second connecting/disconnecting portions are connected and disconnected at a center of a bottom side of said hexagon.

11. A hanger according to claim 9, wherein said first and second connecting/disconnecting portions are an integral part of said main body.

12. A hanger according to claim 10, wherein said first and second connecting/disconnecting portions are an integral part of said main body.

13. A hanger according to claim 9, wherein said first and second connecting/disconnecting portions are each formed in a hook shape.

14. A hanger according to claim 10, wherein said first and second connecting/disconnecting portions are each formed in a hook shape.

15. A hanger according to claim 11, wherein said first and second connecting/disconnecting portions are each formed in a hook shape.

16. A hanger according to claim 12, wherein said first and second connecting/disconnecting portions are each formed in a hook shape.

* * * * *